US005343975A

United States Patent [19]

Riches et al.

[11] Patent Number: 5,343,975

[45] Date of Patent: * Sep. 6, 1994

[54] PERSONNEL FALL-ARREST SYSTEMS

[75] Inventors: David Riches; Leonard J. Feathers, both of Gwynedd, United Kingdom

[73] Assignee: Barrow Hepburn Sala Ltd., Portishead, England

[ * ] Notice: The portion of the term of this patent subsequent to Jul. 6, 2010 has been disclaimed.

[21] Appl. No.: 63,292

[22] Filed: May 18, 1993

Related U.S. Application Data

[63] Continuation-in-part of Ser. No. 807,873, Feb. 13, 1992, Pat. No. 5,224,427.

[30] Foreign Application Priority Data

May 22, 1990 [GB] United Kingdom ..... 9011370.5

[51] Int. Cl.[5] ..... E01B 25/18

[52] U.S. Cl. ..... 182/3; 182/36; 104/115

[58] Field of Search ..... 182/3, 36, 45; 104/115

[56] References Cited

U.S. PATENT DOCUMENTS 1,409,702 3/1922 Gill .
2,724,463 7/1933 Becker .
3,601,862 8/1971 Hargadon .
3,675,283 7/1972 Gregorovic ..... 248/71
4,790,410 12/1988 Sharp et al. .
4,791,253 12/1988 Ibanez et al. .
4,932,626 6/1990 Guillot .
5,224,427 7/1993 Riches et al. ..... 182/3

FOREIGN PATENT DOCUMENTS 2136915 9/1984 United Kingdom .

*Primary Examiner*—Alvin C. Chin-Shue
*Attorney, Agent, or Firm*—Dennison, Meserole, Pollack & Scheiner

[57] ABSTRACT

A personnel fall-arrest system is disclosed in which there is a flexible safety track (1) which is supported in spaced relation to a fixture (2) by brackets (5), and a coupling component (7) for connecting a worker's safety harness to said track via a safety line (8), the coupling component (7) being freely displaceable along said track. The system is characterized in that each of the brackets (5) is formed so that it becomes permanently deformed if subjected to heavy loading due to a fall, thereby signalling that the system requires to be checked and re-certified before further use.

13 Claims, 6 Drawing Sheets

PERSONNEL FALL-ARREST SYSTEMS

This application is a continuation-in-part of U.S. application Ser. No. 07/807,873, filed Feb. 13, 1992, U.S. Pat. No. 5,224,427 issued Jul. 6, 1993.

THE FIELD OF THE INVENTION

This invention relates to a personnel fall-arrest system comprising a flexible safety track held by track supports in spaced relation to a fixture, and a coupling component for connecting a worker's safety harness to said track via a safety line, said component being coupled to said track but being freely displaceable therealong.

The flexible safety track of a system of the kind to which the invention relates can most suitably be a metal cable which is threaded through track-receiving eyes or sleeves provided on the track supports. Such supports and the coupling component can be formed so that displacement of the coupling component along the track is not obstructed by the supports (see e.g. United Kingdom Patent No 2 199 880).

Such systems serve to protect workers in situations where they would otherwise be exposed to risk of serious injury or death by falling. For example, they can be used for protecting workers on walkways running along the exteriors of structures, high above the ground, or on walkways above open vats or other containers holding harmful liquids. Shock-absorbing means is incorporated in or associated with such systems for avoiding such abrupt arrest of a fall as could itself cause serious injury. Such shock-absorbing means is required to comply with performance specifications which limit the force to which a human body is subjected in the event of a fall-arrest. Obviously the fall must not be arrested abruptly. The body must be decelerated over a certain time from the moment the arrest system comes into play. During that time the body continues to fall through a certain distance, usually about 2 to 3 feet. Relevant performance specifications are laid down in, for example, ANSI (American National Standards Institution) Z359.1 (1991).

Each of the components of a personnel fall-arrest safety system should be capable, with a wide margin of safety, of sustaining the forces which may be imposed on it in the event of the fall of a person connected to the coupling component. The track supports must of course hold to the fixture. And they must also resist separation of the track from the supports under any load imposed on them in the event of a fall.

Any personnel fall-arrest system should be systematically examined periodically in order to check that its components have not become damaged and are in serviceable condition. In the event that a fall takes place, it is important that the system be thoroughly checked and that any damaged parts be replaced before the system is again put to use. Such examinations are very demanding tasks, particularly in the case of systems of considerable length and systems in which important components are not conveniently placed for close inspection. The examinations have to be carried out in situ, where there is an inherent risk of personal accident. The work should be carried out by trained inspectors but despite every care there is always the possibility of a defect being overlooked.

SUMMARY OF THE PRESENT INVENTION

An object of the present invention is a system wherein there is means which reduces the risk that impairment of the system, caused by heavy loading due to a fall, may be overlooked.

More particularly the invention provides a system wherein individual safety track supports can perform a "tell-tale" function by undergoing permanent plastic deformation if it is subjected to a heavy load such as is imposed in the event of the fall of a person using the system. Each of the track supports has an ultimate strength more than sufficient to resist breakage of such support, with consequent release of its hold on the safety track, under the maximum load liable to be imposed on it in the event of the fall of a person using the system. However, each support is permanently deformable, with consequent downward displacement of the portion of the safety track held by that support, under a load substantially smaller than such maximum. The deformation is sufficient for it to be visually apparent to an inspectorate. It therefore alerts an inspectorate to the fact that the system has been heavily stressed and that repair work must be done before the system can be certified for re-use. The invention departs from the common perception that the safety track supports in a personnel fall-arrest system should be robust enough to sustain a full range of fall-arrest loads without damage.

The susceptibility of the track supports to deformation gives them the potential not only to signal that a fall has occurred but also to indicate the region along the system where the fall took place. Generally speaking, a large proportion of the load imposed on arrest of a person during free fall will be transmitted from the safety track to the fixture via the track supports nearest the position where the fall takes place. With a system as used prior to the present invention, even if steps are taken, following a fall, to warn against further use of the system until it has been re-certified as in good order, it is possible for the system to be left, after the rescue operation, without any record of the actual place along the system where the fall occurred. Knowledge of where the system has been most heavily loaded does not relieve an inspectorate of responsibility for checking the entire system but it does ensure that the most heavily stressed part of the system will receive particularly careful attention.

The occurrence of an obvious plastic deformation of a track support under a given load can be ensured by appropriate choice of the material used in the construction of the support and of its form and dimensions.

As explained above, damage of a track support in a system according to the invention serves as an inspectorate alert signal. The resistance of the support to change of physical form under load determines the response threshold or "sensitivity" of the signal.

The resistance to deformation which the track supports of any given system should have, depends in part on the maximum load to which they may be subjected in the event of the fall of a person using the system. That maximum load depends of course on the specifications of the fall-arrest system as a whole, including its shock-absorbing means. The deformation resistance of an individual support must be low enough to ensure that it will yield, by deformation, under a load substantially smaller than that maximum. The said resistance also depends on the required signal sensitivity. It is not necessary and generally speaking it is not practical for the deformation resistance of the supports to be so low that a track support will become deformed by any load, however small, imposed in consequence of a fall, or a stumble, of a person using the system. It will normally suffice for the response threshold to be such that permanent deformation only occurs if the system is subjected to loading forces which would otherwise entail a real risk of some part or parts of the system sustaining damage without inducing any obvious warning sign that such damage may have occurred.

It is preferable for individual track supports to undergo readily perceivable permanent deformation when subjected to a load of 5 KN or less in a Yield Test as follows:

Yield Test

The track support to be tested is secured to a fixture in the same way as it would be if it were used as intended in an actual fall-arrest system. A traction force is applied to the track-receiving portion of the support by a traction machine working at an extension rate of 0.5 inches (1.27 cm) per minute. The direction in which that force is applied in relation to the orientation of the support is such as to simulate the action of a force exerted vertically downwardly on that portion of the support when it is in its intended orientation in an actual fall-arrest system. The distance, measured in the direction in which the force is applied, by which the said track-receiving portion of the support is displaced from its original position in consequence of the application of a given force, as indicated on the machine gauge, is a measure of the extent of deformation which the support undergoes under that force.

A yield resistance of 5 KN as measured by the foregoing Yield Test is not an absolute maximum but the safety track supports can only have a yield resistance of that relatively high value in the case of a system in which the supports are likely to be subjected to loading forces substantially in excess of 5 KN in the event of the arrest of a free fall.

In general it is preferable for the safety track supports of any system according to the invention to have a yield resistance below 5 KN. The yield resistance of the supports must be such that one or more supports in the vicinity of the location where a fall takes place undergoes permanent deformation before the load on such support(s) begins to diminish as a result of the action of the shock absorbing means. In view of this requirement, in preferred embodiments of the invention the yield resistance of individual track supports in the system is such that they undergo obvious permanent deformation when subjected to a load of 3 KN in the above described Yield Test. There is then ample scope for a shock absorber which comes into play after such deformation has taken place, to limit the maximum arrest force sustained by the falling body to a value below that permitted by local safety standards. Preferably the yield resistance of individual track supports, as determined by the foregoing Yield Test, is such that the extent of permanent deformation, measured in terms of the specified displacement of the track-receiving portion of the support, is at least 2 cm under a force of 3 KN. Observance of this condition is likely to ensure that any deformation of a support caused by the imposition of fall-arrest forces on the system in the vicinity of a support will be very obvious.

In certain embodiments of the invention, each track support is constructed so that in a Yield Test as hereinbefore specified, it will undergo apparent permanent deformation under a traction force which is less than 60% of the maximum load to which the support is liable to be subjected (due to a fall) during use of the system in which the support is incorporated. It is also recommended that each support be constructed so that in a said Yield Test it undergoes a said apparent permanent deformation under a traction force in the range of 2.5 to 4.5% of the ultimate tensile strength of the support.

The track supports of a system according to the invention serve to hold the safety track in close spatial relationship to the fixture to which they are secured. In general use is made of supports dimensioned so that the fixture-to-track distance is less than 12 cm, and preferably less than 9 cm. This implies that the supports are of small dimensions and can be made to the required strength specifications without using very heavy gauge material. The use of track supports of small size also implies that in the fall-arrest system, the maximum distance over which the track-receiving portion of any such support can be downwardly displaced due to deformation of the support under load is likewise small. It is preferred and recommended that the individual supports be constructed and dimensioned so that in a Yield Test as hereinbefore specified, the maximum extent to which the track-receiving portion of the support can be displaced in the direction of the applied force before the support ruptures is less than 12 cm, and most preferably that maximum displacement is not more than 9 cm.

In the event of the fall of a person using the system, no individual track support will be loaded to the limit of its strength, i.e. to a load great enough to rupture the support, and by observing the foregoing preferred condition relating to the maximum possible deformation, it is ensured that the deformation of one or more of the track supports caused by a fall will not significantly increase the distance through which the person falls before the fall is arrested. A substantial increase in the fall distance due to deformation of one or more track supports would be undesirable. It could for example entail an additional hazard. It is therefore preferable to work well within the said foregoing deformation limit. In particular, preference is given to embodiments of the invention in which the individual track supports are constructed and dimensioned so that if any of the supports is subjected to a a Yield Test as hereinbefore specified the distance through which the track-receiving portion of the support is displaced during increase of the applied force from zero to 5 KN is not more than 9 cm; and especially to embodiments in which that distance is considerably less than 9 cm.

In use of a system according to the invention, any permanent plastic deformation of any one or more of the track supports which occurs due to a fall affords local stress relief but its shock-absorbing function is negligible. The track supports are incapable of effecting the shock-absorption necessary for safeguarding personnel against serious injury in the event of a fall. Shock-absorbing means must be provided for that purpose in accordance with conventional practice to comply with relevant safety standards.

It is recommended to use track supports each of which comprises a metal strap which follows a course extending from the fastening means (the fastening means by which it is secured to the fixture) to the safety track, around the safety track and back again to the fastening means. Such a strap is preferably formed from a single piece of metal which is bent to shape. However such a strap can be formed from separate pieces of metal provided they are secured together in a way which makes the joint capable of resisting rupture under a loading in excess of the maximum to which the strap is liable to be subjected in the event of a fall-arrest. If more than one piece of metal is used for forming the strap the pieces are preferably joined by a nut and bolt fastener. A secure joint can be more easily and reliably formed in that way than by welding. It is in any case very advantageous for the strap to be secured to the fixture by fastening means which passes through overlapping portions of the strap.

It is preferably for track supports formed from a metal strap as aforesaid to be constructed so that material of the support between the fixture and the safety track forms a loop. The adoption of such a looped geometric form facilitates reliable repetitive manufacture of supports having a high ultimate tensile strength in combination with a relatively low predetermined resistance to permanent plastic deformation.

A particularly advantageous form of track support is one formed from a metal strap as aforesaid and having a head portion which surrounds and locates the safety track, a body portion formed by a loop of material between that head portion and the fixture, and a neck portion joining said head and body portions. When subjected to progressively increasing traction in a Yield Test as hereinbefore described, the strap becomes deformed, before rupture thereof, into a condition in which the parts of the strap which previously formed the head, neck and body portions of the support form parts of a single loop. It is particularly beneficial for the said material between the fixture and the safety track to form a polygonal loop by which the support is secured to the fixture, and a neck portion projecting from one corner of the polygon. Such a geometric form can confer very desirable performance properties on the support.

If the safety track is secured to a vertical surface or surfaces of a fixed structure, it is beneficial for the individual track supports to be fastened to such structure by a single fastener about which the support will bodily pivot if a sufficiently large turning moment is imposed on it in consequence of heavy loading of the track at a position on one side of the support. If a portion of the safety track between two supports is pulled downwardly and subjected to heavy loading as a result of a fall, the forces transmitted to those two supports can cause them to pivot about their fasteners so that the forces on the head portions of the supports and the stresses on the contacting portions of the safety track are better distributed.

SUMMARY OF THE DRAWINGS

The invention is illustrated, by way of example only, in the accompanying drawings. In these drawings.

DETAILED DESCRIPTION OF THE ILLUSTRATED EMBODIMENTS

Figure 1:
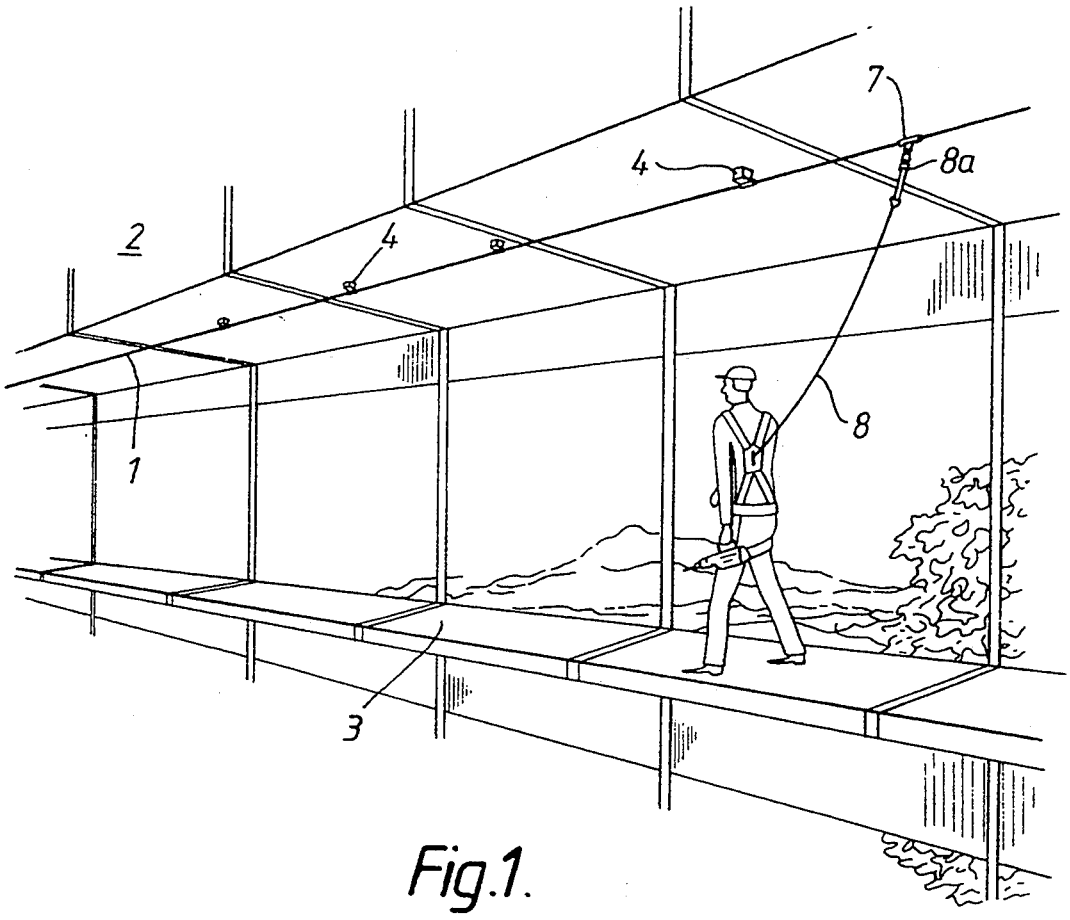
FIG. 1 shows part of a personnel fall-arrest system according to the invention.
Figure 2:
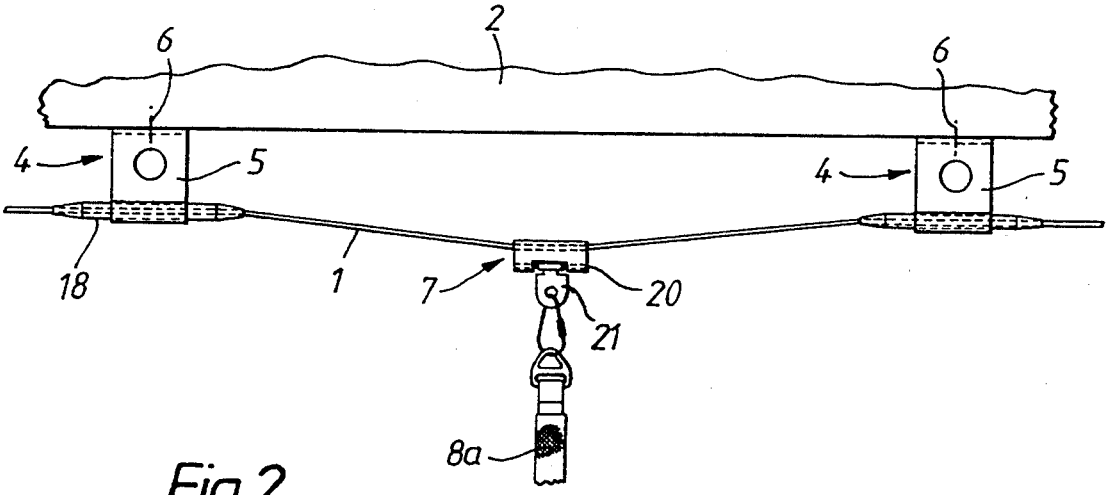
FIG. 2 shows a part of the system at the moment of a fall-arrest.

In the fall-arrest system represented in FIGS. 1 and 2, a safety track in the form of a wire cable 1 is strung along the underside of a structure 2 overhanging a worker's walkway 3. The cable can follow an endless course around the structure or it may extend between stations at which the ends of the cable are secured to the fixture via suitable end fittings on the cable. The cable is held closely spaced from the underside of the structure 2 by supports 4 which are fastened to the structure by bolts 6. Each of the supports 4 is in the form of a cable-supporting and locating bracket 5 as described in detail hereafter.

A coupling component 7 is threaded onto the cable 1 and is freely slidable therealong. A worker's safety harness is connected to that coupling component via a lanyard 8. The lanyard incorporates a shock-absorbing device 8*a* as known per se. In this case the device 8*a* is of tear-webbing type.

Figure 3:
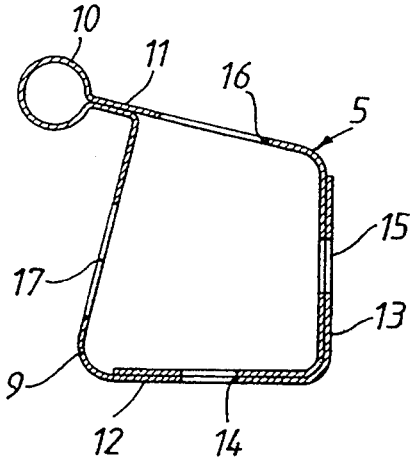
FIG. 3 is a side sectional elevation of part of a track support used in that system.
Figure 4:
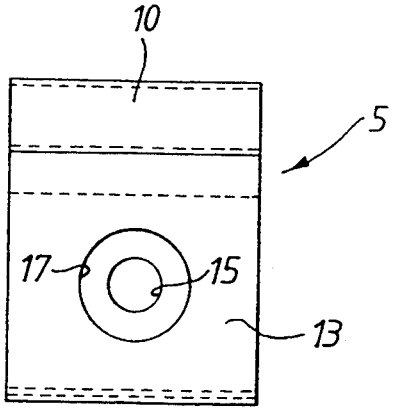
FIG. 4 is a front elevation of that support.

The construction of the track-supporting brackets 5 is shown in FIGS. 3 and 4. Each bracket has a body portion 9 in the form of a quadrilateral loop, a head portion 10 of tubular form and a neck 11 joining the head and body portions. The bracket is formed from a metal strap, which in this case is formed by a single strip of metal, by bending the strap about transverse axes. Opposed end portions of the strip overlap to give two sides 12,13 of the quadrilateral body portion a thickness twice that of the strap. The overlapping end portions of the strap are spot-welded together in each of the sides 12,13. Holes 14,15 are formed in the body sides 12,13 respectively for the reception and location of a fastening bolt 6 (FIG. 2). Each bracket is secured to the fixture by only one bolt. The bracket can be orientated with either body side 12 or body side 13 against the fixture and it is for that reason that each of those sides is formed with a hole for a fastening bolt. Larger holes 16,17 are formed in the body sides which are opposite sides 12 and 13 to allow access of a tool to the head of the bolt. It will be noted that when the bracket is in use, the metal strap from which it is formed follows a course extending from the fastening bolt 6 to the safety track, around the safety track, and back again to the fastening means.

Figure 5:
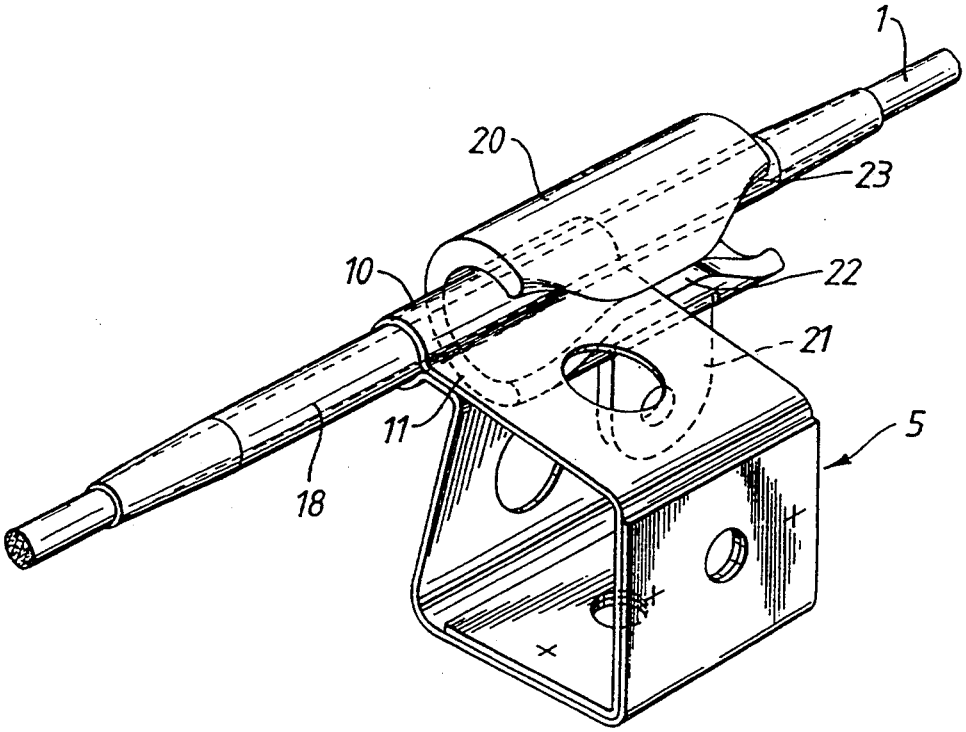
FIG. 5 is a perspective view of that support and cooperating parts of the system.

In the installed system, the cable 1 passes through the tubular head portions 10 of the brackets 5. The cable can slide axially within the head portion of each bracket. It is beneficial to fit the tubular head portion of each bracket, as shown in FIGS. 2 and 5, with a flexible extension tube 18 which projects from each side of such head portion. It is very suitable for such extension tube to be of synthetic polymeric material, e.g. nylon. The extension tubes afford relatively low frictional restraint to sliding movement of the cable 1 and if a part of the cable between two brackets is pulled downwardly by fall-arrest forces as indicated in FIG. 2, the extension tubes of those brackets serve to avoid high stress concentration on the cable due to localised bearing contact with the metal head portions.

Figure 9:
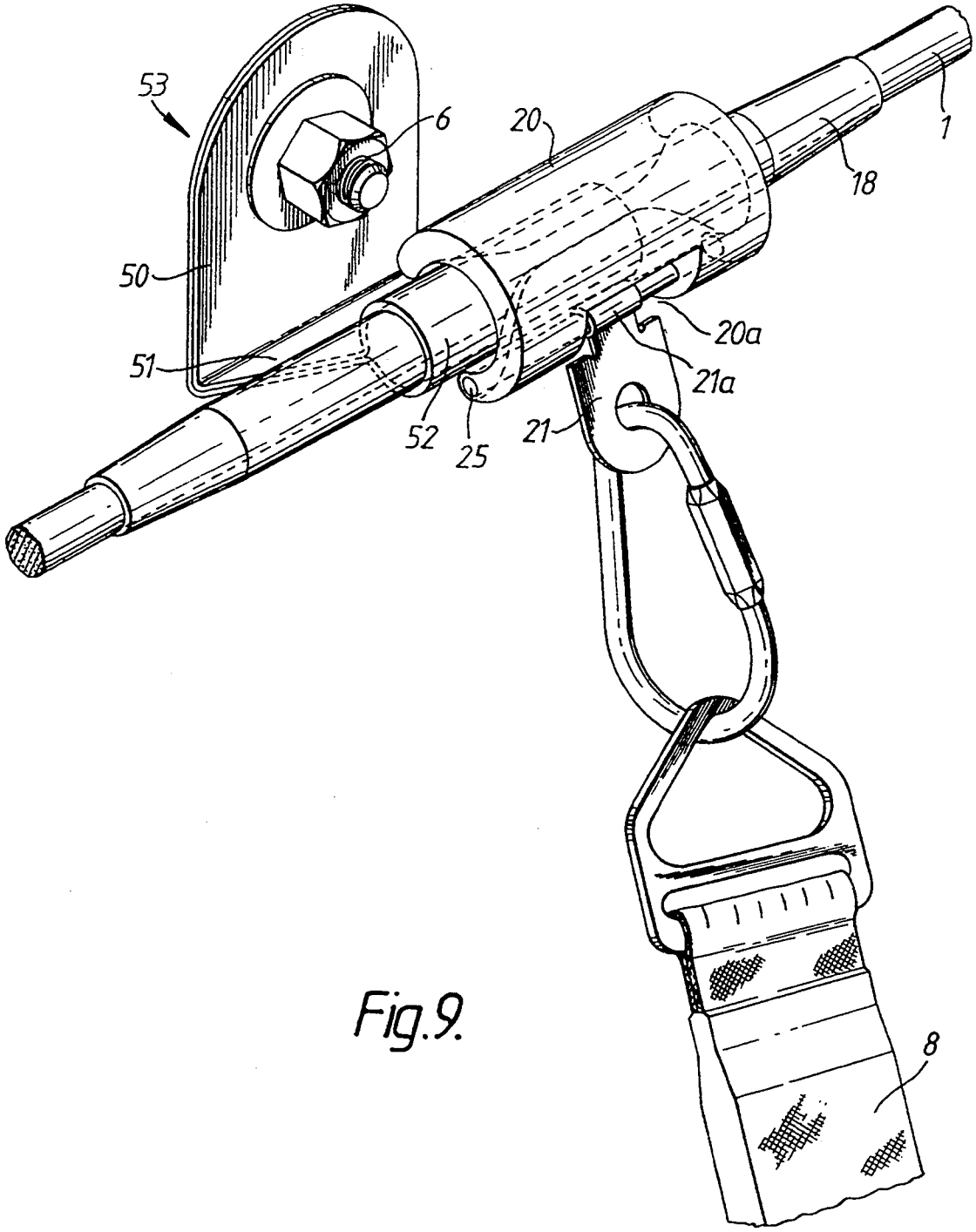
FIG. 9 is a perspective view of part of a system according to the invention which incorporates track supports of yet another form.

The following is a description of the construction of the coupling component 7 as shown in FIGS. 2, 5 and 9. The component comprises a longitudinally slotted tube 20. A link 21 for connection to the worker's lanyard 8 as shown in FIGS. 1 and 2 is pivotally connected to the wall of that tube. The bore of the tube 20 is larger than the external diameter of the track-receiving tubular head portions 10 of the brackets 5 so that the slotted tube can slide over those bracket head portions. The longitudinal slot 22 has over a central portion of its length a width which is substantially smaller than the diameter of the cable 1 but is a little greater than the thickness of the neck portions 11 of the brackets. The opposed end portions of the slot 22 are flared so that the mouth of the slot at each end of the tube is relatively wide. The flared portions provide cam faces or edges 23. The link 21 has a sleeve portion 21*a* (FIG. 9) which is traversed by a pivot pin 25. This pivot pin bridges an opening 20*a* in the wall of the tube 20. The end portions of the pin are secured in receptive holes formed in that tube wall. The diameter of the pivot pin is such that it passes through the sleeve portion 21*a* of the link with clearance, so that the link is very freely pivotable relative to the slotted tube. The pivot pin 25 is angularly spaced by 90° (around the axis of the slotted tube) from the longitudinal centre line of the slot 22.

As a worker moves along the walkway 3 (FIG. 1), the coupling component is drawn along the cable 1 by the pulling force on the lanyard 8. When the slotted tube reaches one of the cable brackets, first the bracket extension tube 18 and then the bracket head portion 10 enters the bore of the slotted tube. The neck portion 11 of the bracket enters the slot 22. The coupling component therefore advances smoothly past the bracket. If the angular orientation of the slotted tube around the cable 1, at the time that tube arrives at the bracket, is not such that the central narrow portion of the slot 22 is in alignment with the neck 11 of the bracket, that neck will abut against one or another of the said cam faces or edges 23 and thereby cause the tube 20 to turn so that the coupling component continues its movement past the bracket without any impedance.

Figure 6:
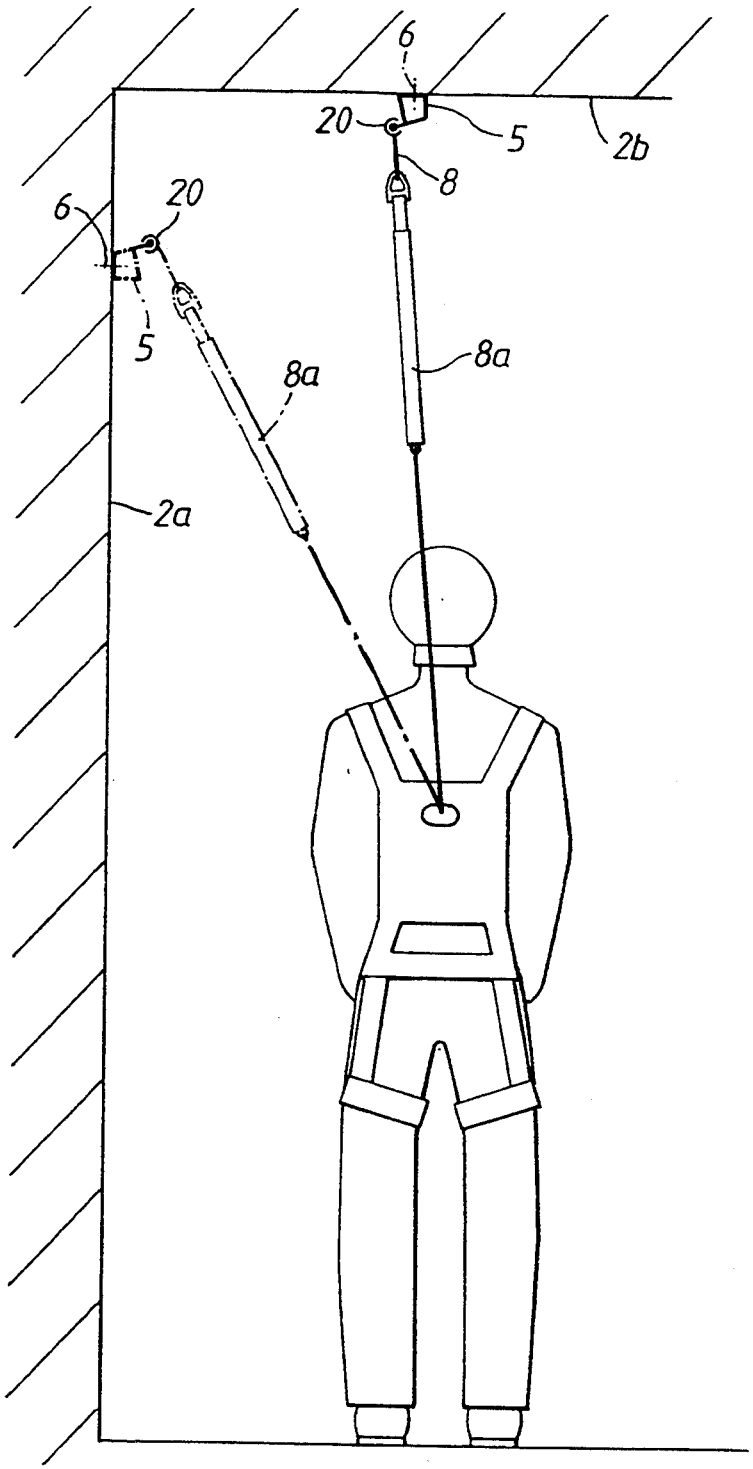
FIG. 6 shows alternative fixing positions of such a support in relation to a walkway.

FIG. 6 shows in full line the way in which track-supporting brackets of the form shown in FIGS. 2–5 are orientated in relation to the overhead fixture in the system depicted in FIG. 1. FIG. 6 shows in broken line a way in which the brackets can be arranged for securing a safety track to a vertical surface 2*a*. When the coupling component 7 is being drawn along the cable 1 by a pulling force on the worker's lanyard 8, the angular orientation of the slotted tube 20 around the cable will be such that the slot 22 is disposed to one side of the cable. The slot must be to the same side of the cable as the neck portions 11 of the brackets. Provided that condition is satisfied, the coupling component will travel smoothly past the brackets as previously described. As is apparent from FIG. 6, that condition is satisfied in both of the illustrated bracket mounting positions. For suiting the bracket position shown in broken line, in which the neck portion of the bracket is on the left hand side of the cable in the aspect of the drawing, the coupling component 7 is fitted on the cable, at the time when the system is installed, in an orientation which is the end-for-end reversal of that which suits the bracket position shown in full line. In the installation shown in FIG. 6 the associated shock-absorber 8*a* is of longer format than the one shown in FIG. 1.

Safety apparatus incorporating a coupling component of the form shown in FIGS. 2, 5 and 12 is described and claimed in International Patent Application PCT/GB92/00916 in which the United States of America is a designated state.

Track supporting brackets as described with reference to FIGS. 3 and 4 were individually subjected to the Yield Test as hereinbefore set out. Each bracket was formed from a 16 SWG strip of austenitic stainless steel. The strip had a width of 60 mm. Each bracket had the following dimensions (referring to FIG. 3):

| | |
|---|---|
| Vertical height from a horizontal plane through the centre of the head portion 10 to the base 12: | 67 mm |
| Horizontal distance from a vertical plane through the centre of the head portion to the outer face of side 13: | 67 mm |
| Height of side 13: | 54 mm |
| Overall length (measured in the plane of the drawing) of the base 12: | 60 mm |
| External diameter of the head portion: | 18 mm |
| Diameter of apertures 14, 15 | 13 mm |
| Diameter of apertures 16, 17: | 30 mm |

Figure 7A:
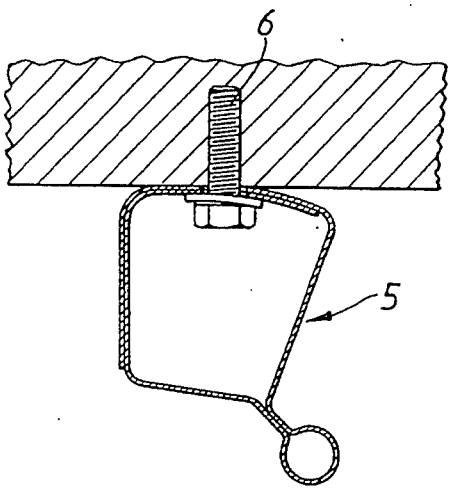
FIGS. 7*a* and 7*b* shows stages in the deformation of such a support under load.
Figure 7B:
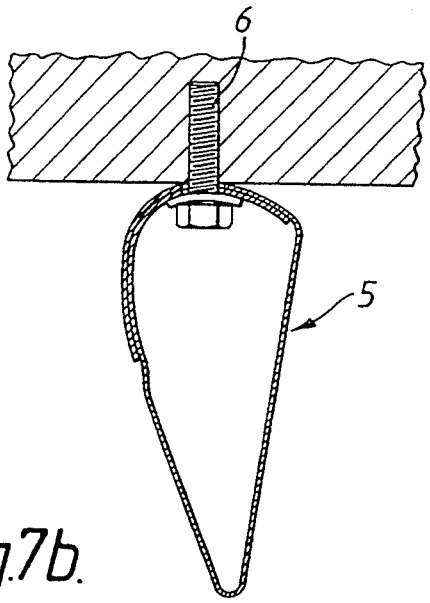

In a first test one of the brackets was secured to a fixture with side 12 (FIG. 3) of the bracket against the fixture in the same way as the bracket shown in full line in FIG. 6. A rigid bar was inserted through the head portion 10 of the bracket and traction force was exerted on the bracket by the traction machine via that bar. The traction force was exerted in a direction normal to the fixture surface against which the bracket was secured. Substantial plastic deformation of the bracket occurred before the traction force reached 2 KN. FIG. 7*a* represents the shape into which the bracket had become permanently deformed by the traction force when it reached 2.5 KN. At that stage the displacement of the head portion of the bracket from its original position (measured parallel with the direction of the tractive force) had reached 2 cm. The traction force was further increased, at the same rate, to determine the ultimate tensile strength of the bracket. That ultimate tensile strength was found to be 49.24 KN. At that loading the metal strip fractured at the location of the fastening bolt 6. Before breakage, the entire metal strip had become deformed into a single loop as depicted in FIG. 7*b*.

In a further test, an identical bracket was secured to a fixture with side 13 (FIG. 3) of the bracket against the fixture in the same way as the bracket shown in broken line in FIG. 6. The test was carried out in the same manner as the previous one except that in this case the traction force was exerted parallel with side 13 of the bracket and in a direction towards the plane of side 12 thereof. In this test also, substantial permanent plastic deformation of the bracket occurred before the traction force reached 2 KN. At the stage the traction forced reached 2.5 KN the head portion of the bracket had become permanently displaced from its original position by a distance (measured parallel with the direction of the traction force) of 4 cm. The ultimate tensile strength of the bracket, determined by continuing to increase the traction force at the same rate, was found to be 50.94 KN. At that loading the metal strip fractured at the location of the fastening bolt 6. As in the preceding test, the metal strip became deformed into a single loop before breakage occurred.

The very favourable combination of properties of the bracket: its ultimate strength, yield resistance and deformation characteristics, are contributed to by the polygonal form of the bracket body, the presence of single-ply corner angles at the junctions of single-ply sides 16 and 17 with the double-ply fixing sides 12,13, and the double-ply construction of the neck 11.

Figure 8:
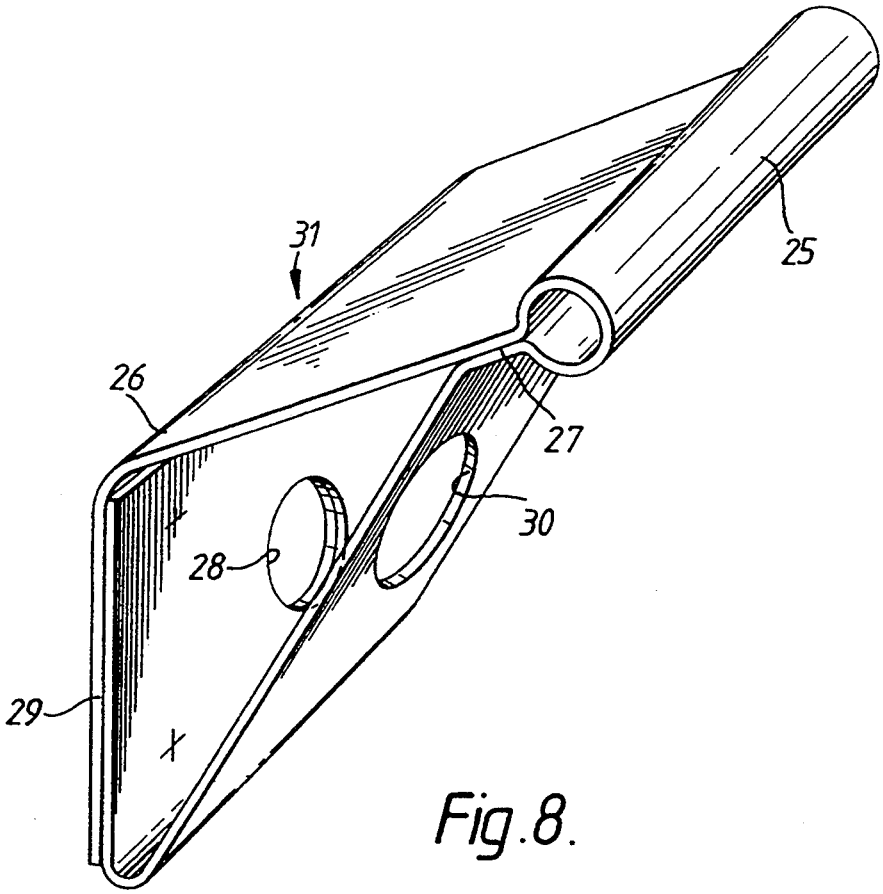
FIG. 8 shows a track support of another form.

FIG. 8 shows an alternative form of track supporting bracket which can be employed in a system according to the invention. The bracket 31 comprises a tubular head portion 25, a body portion 26 in the form of a triangular loop, and a neck portion 27 joining such head and body portions. The bracket can be secured to a surface by a bolt fitted through hole 28 in side 29 of the body portion of the bracket. A hole 30 of larger diameter is provided in the opposite wall of the body portion to allow access of a tool to the anchor bolt head. The bracket has been formed from a single strip of metal. End portions of the strip overlap and are spot-welded together to provide a double thickness of material where the fastening bolt will be located. It is a straightforward matter to select the bracket material and dimensions so that the bracket combines a requisite high ultimate tensile strength with a relatively low resistance to permanent deformation under load in accordance with the requirements of the invention.

FIG. 9 shows part of a system according to the invention which except for the track supporting brackets is the same as that described with reference to FIGS. 1 to 5. Parts of the system corresponding with parts of the system according to FIGS. 1 to 5 are denoted by the same reference numerals. Each of the brackets 53 in the system according to FIG. 9 is formed by a strip of metal which is bent to form a two-ply base flange 50, a two-ply cantilever arm 51 and a tubular track-receiving head portion 52 at the free end of that arm. Like the bracket shown in earlier figures, the strip from which the bracket is formed follows a course from its fastening bolt 6 to the safety track 1, around that track, and back to the anchoring bolt. It is a straightforward matter to select the material and dimensions of a bracket of that form so that it has the required high ultimate tensile strength and a relatively low resistance to permanent plastic deformation as required by the invention.

Figure 10:
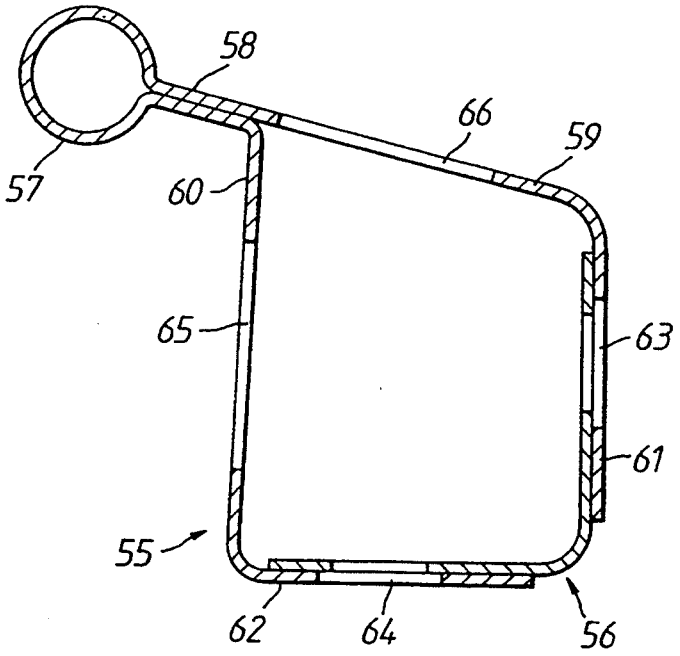
FIGS. 10 and 11 are side sectional and front elevations respectively of another construction of track support which can be used in a system according to the invention.
Figure 11:
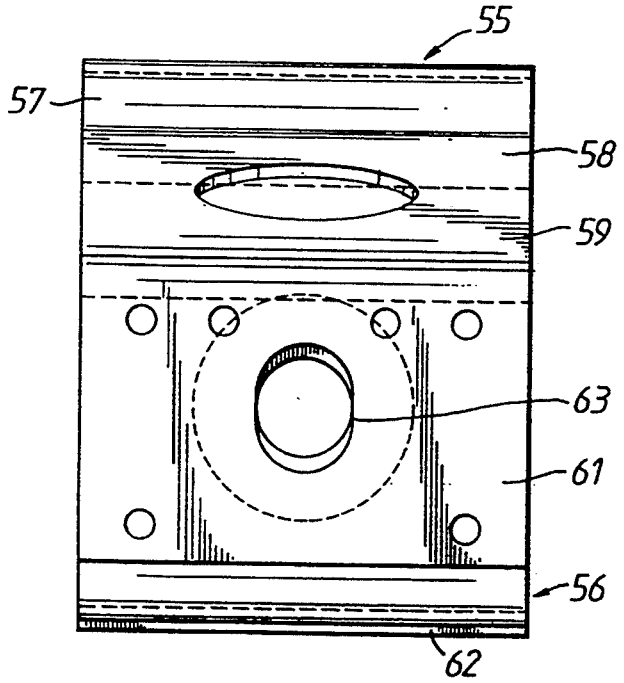

The bracket shown in FIGS. 10 and 11 is of similar form to that shown in FIGS. 3 and 4 but it is formed from two metal strips, 55,56. Strip 55 has been bent to form the head portion 57, the neck portion 58, two sides 59 and 60 of the quadrilateral body portion of the bracket, and one of the two plies of each of the other sides 61 and 62 of such body portion. The other plies of those sides 61 and 62 are formed by the second metal strip 56. In the two-ply sides 61,62 of the bracket there are holes 63,64 (one in each side) for the passage of bolts (not shown). In the body sides 59,60, opposite the holes 63,64, there are larger holes 65,66 to allow access of a tool to the heads of the bolts.

When a system incorporating brackets as shown in FIGS. 10 and 11 is installed, the two strips composing each bracket are fastened together by two fasteners extending one through hole 63 and the other through hole 64. As in the case of the bracket shown in FIGS. 3 and 4, a bracket according to FIGS. 10 and 11 can be secured against a horizontal or vertical fixture surface by a single bolt. The bolt will extend through hole 63 or 64 to secure body side 61 or 62 against such surface, depending on the orientation of the bracket. Thus the anchor bolt itself serves to secure the two metal strips together at one of the two-ply sides of the body portion of the bracket. The other of the two-ply sides of the body portion are secured together by fastener means extending through hole 63 or 64 as the case may be. It is very suitable to use a nut and bolt type fastener. By such means the two strips can be very reliably secured together so that they do not separate at the joint under the maximum deformation force likely to be imposed on the bracket.

We claim:

1. A personnel fall-arrest system for arresting the fall of a person relative to a fixture (2) wherein there is a flexible safety track (1), track supports (5,31,53) which are secured to the fixture (2) by fastening means (6), each of said supports having a track-locating head portion (10,25,52) of tubular form through which such track extends and is thereby held in spaced relation to said fixture (2);

including a coupling component (7) by which a safety line (8) attached to a worker's safety harness can be coupled to said safety track (1), said coupling component (7) being coupled to said track but being freely displaceable therealong;

and wherein each of said track supports (5,31,53) comprises a metal strap device which follows a course extending from said fastening means (6) to the safety track, around the said safety track and back again to said fastening means (6), which fastening means extends through overlapping portions of said strap device;

said metal strap device having an ultimate strength more than sufficient to prevent release of the track under the greatest load liable to be imposed on it in the event of the fall of a person using the system, but undergoes obvious permanent deformation under a load substantially smaller than that maximum whereby the occurrence of permanent deformation of the strap device serves as an inspectorate alert signal warning that the support has been subjected to heavy stress which might be due to a fall.

2. A system according to claim 1 wherein each of said track supports (5,31,53) comprises a said metal strap which is constituted by plural strips (55, 56) of metal, and wherein the fastening means (6) extends through the plural strips (55, 56) where they overlap.

3. A system according to claim 1 wherein each track support (5,31) has a body portion (9,26) in the form of a loop by which the support is secured to the fixture (2), and a neck portion (11,27) between that body portion and the head portion (10,25) of the support.

4. A system according to claim 1 wherein each track support (5) has a body portion (9) in the form of a polygonal loop, by which the support is secured to the fixture (2), and a neck portion (11) between that body portion and the head portion (10) of the support, and wherein said polygonal loop has at least one pair of adjacent sides (12,13) at right angles to each other and in each side of that pair there is an aperture (14,15) for the passage of a fastening means whereby said support can be secured to a vertical as well as a horizontal fixture surface.

5. A system according to claim 1 wherein each of the track supports (5,31,53) has a resistance to permanent deformation such that if the support is subjected to a Yield Test in which after securing the support to a fixture in the same way as it is in the fall-arrest system, a traction force is applied to the head portion (10,25,52) of the support by means of a traction machine working at an extension rate of 0.5 inches (1.27 cm) per minute so as to subject the support to a traction force of 3 KN in the direction in which it would be loaded in the event of the fall of a person using the system, that force causes the said head portion of the support to be displaced from its original position by a distance, measured in the direction in which the force is applied, of at least 2 cm.

6. A system according to claim 1 wherein each of the track supports (5,3,1,52) has a resistance to permanent deformation such that if the support is subjected to a Yield Test in which after securing the support to a fixture in the same way as it is in the fall-arrest system, a traction force is applied to the head portion (10,25,52) of the support by means of a traction machine working at an extension rate of 0.5 inches (1.27 cm) per minute so as to subject the support to a traction force of 5 KN in the direction in which it would be loaded in the event of the fall of a person using the system, that force causes the said head portion of the support to be displaced from its original position by a distance, measured in the direction in which the force is applied, of not more than 9 cm.

7. A personnel fall-arrest system as claimed in claim 1, including a walkway (3) secured to the fixture (2), the walkway (3) being located at height adjacent the fixture (2) while allowing freedom of movement of the person along such walkway, wherein a flexible safety track (1) is installed in closely spaced relationship to said fixture (2) along a course generally parallel with such walkway; and wherein, at intervals along said course, the safety track is supported by track supports (5,31,53) having a track-locating head portion (10,25,52) through which the track is threaded;

there being a coupling component (7,20) for coupling a worker's safety line (8) to said track (1), said coupling component (7,20) being coupled to said track but being freely displaceable therealong.

8. A system according to claim 7, wherein the supports are dimensioned so that the fixture-to-track distance is less than 12 cm.

9. A system according to claim 7, wherein the supports are dimensioned so that the fixture-to-track distance is less than 9 cm.

10. A system according to claim 7, wherein the individual supports are constructed and dimensioned so that if a said support is subjected to a Yield Test in which after securing the support to a fixture in the same way as it is in the fall-arrest system, a traction force is applied to the track-locating head portion (10,25,52) of the support, in the direction in which it would be loaded in the event of the fall of a person using the system, by means of a traction machine working at an extension rate of 0.5 inches (1.27 cm) per minute, the maximum extent to which said track-locating head portion can be displaced in the direction of the applied force before the support ruptures is less than 12 cm.

11. A system according to claim 7, wherein the individual supports are constructed and dimensioned so that if a said support is subjected to a Yield Test in which after securing the support to a fixture in the same way as it is in the fall-arrest system, a traction force is applied to the track-locating head portion (10,25,52) of the support, in the direction in which it would be loaded in the event of the fall of a person using the system, by means of a traction machine working at an extension rate of 0.5 inches (1.27 cm) per minute, the distance through which said track-locating head portion of the support is displaced during increase of the applied force from zero to 5 KN is not more than 9 cm.

12. A system according to claim 7, wherein in the track-locating head portion (10) of at least one of said track supports (5) there is a flexible track-guiding tube (18) whose end portions project from opposite sides of said head portion.

13. A personnel fall-arrest system as claimed in claim 1 and wherein there is a flexible safety track (1) which is held in spaced relation to the fixture (2) by track supports (5,31,53) located at intervals along the track (1); and including a coupling component (7) by which a safety line (8) attached to a worker's safety harness can be coupled to said safety track, said coupling component (7) being coupled to said track but being freely displaceable therealong;

each of said track supports (5,31,53) having a track-locating head portion (10,25,52) and a body portion (9,26,50-51) which is secured to a substantially vertical surface (**2*a*) of said fixture (2) by a single fastener (6) about which the support will pivot if a sufficiently large turning moment is imposed on it in consequence of the exertion of a downward pulling force on the track (1**) at a position on one side of the support.

* * * * *